US005242790A

United States Patent [19]

Hioki et al.

[11] Patent Number: 5,242,790

[45] Date of Patent: Sep. 7, 1993

[54] SILVER HALIDE EMULSION

[75] Inventors: Takanori Hioki; Yoshio Inagaki, both of Kanagawa, Japan

[73] Assignee: Fuji Photo Film Co., Ltd., Kanagawa, Japan

[21] Appl. No.: 942,620

[22] Filed: Sep. 10, 1992

[30] Foreign Application Priority Data

Sep. 11, 1991 [JP] Japan ..... 3-258741

[51] Int. Cl.[5] ..... G03C 1/10; G03C 1/22

[52] U.S. Cl. ..... 430/591; 430/592

[58] Field of Search ..... 430/595, 592, 591

[56] References Cited

U.S. PATENT DOCUMENTS 3,933,507 1/1976 von Konig et al. ..... 430/584

FOREIGN PATENT DOCUMENTS 551532 1/1958 Canada ..... 430/592
1008115 5/1957 Fed. Rep. of Germany ..... 430/592
1522409 5/1973 Fed. Rep. of Germany ..... 430/592
57-79940 5/1982 Japan ..... 430/595

*Primary Examiner*—Janet C. Baxter
*Attorney, Agent, or Firm*—Sughrue, Mion, Zinn, Macpeak & Seas

[57] ABSTRACT

There is disclosed a silver halide photographic light-sensitive material which has a high sensitivity and is less susceptible to an increase in fog and fluctuation of sensitivity during storage at a high temperature and/or a high humidity. The light-sensitive material contains at least one methine compound represented by Formula (I):

(I)

wherein $R_1$ represents an alkyl group; $R_2$ represents an alkyl group, an aryl group or a heterocyclic group; $L_1$, $L_2$, $L_3$ and $L_4$ each represents a methine group; $Z_1$ represents a group of atoms necessary to form a 5- or 6-membered nitrogen-containing heterocyclic ring; $n_1$ represents 0 or 1; $n_2$ represents 0 or an integer of 1 to 4; $n_3$ represents an integer of 1 to 10; D represents a group of atoms necessary to form an acidic nucleus; $M_1$ represents a charge-neutralizing ion; and $m_1$ represents a number of 0 or more which is necessary to neutralize a charge contained in the compound.

6 Claims, No Drawings

SILVER HALIDE EMULSION

FIELD OF THE INVENTION

The present invention relates to a novel methine compound. Further, the present invention relates to a silver halide emulsion containing the novel methine compound, more specifically to a silver halide emulsion having a high sensitivity and a reduced susceptibility to fluctuation in sensitivity which results during storage. Further, the present invention relates to a dye for photography.

The novel methine compound of the present invention can be incorporated into pharmaceuticals, dyes and an optical information recording media such as optical discs, as well as into a photographic silver halide emulsion.

BACKGROUND OF THE INVENTION

Well known are technique in which the sensitive wavelength range of a silver halide emulsion is expanded by adding thereto a sensitizing dye to optically sensitize it.

Many known spectral sensitizing dyes are used for this purpose. They include, for example, a cyanine dye, a merocyanine dye and a xanthene dye each described at pages 198 to 228 of *The Theory of the Photographic Process*, the third edition, edited by T. H. James, 1966, published by Macmillan Co., Ltd.

When these sensitizing dyes are applied to a silver halide emulsion, not only do they expand the sensitive wavelength range of the silver halide emulsion, they must also satisfy the following conditions:

(1) spectral sensitizing range is appropriate,
(2) sensitizing efficiency is good and a sufficiently high sensitivity can be obtained,
(3) fog does not result,
(4) fluctuation in sensitivity due to a fluctuation in temperature during exposure is small,
(5) there are no bad interactions with other additives, for example, a stabilizer, an anti-foggant, a coating aid and a color developer,
(6) sensitivity does not fluctuate when a silver halide emulsion containing a sensitizing dye is stored, even at a high temperature and humidity, and
(7) an added sensitizing dye, which is diffused into the other light-sensitive layers, does not cause a color stain (a color mixing) after development.

The above conditions are important during the preparation of a silver halide emulsion used in a silver halide photographic light-sensitive material. In spite of various attempts, however, reduction in sensitivity of an unprocessed sample during storage has not been prevented to a satisfactory degree.

SUMMARY OF THE INVENTION

An object of the present invention is to provide an effective dye compound.

Another object of the present invention is to provide a silver halide photographic light-sensitive material which has a high sensitivity and is less susceptible to an increase in fog and the fluctuation of a sensitivity (that is, it has an excellent storing performance in ambient conditions before processing) during storage at a high temperature and/or a high humidity.

These and other objects of the present invention have been achieved by the methine compounds represented by Formula (I).

Also, these and other objects of the present invention have been achieved by a silver halide emulsion containing at least one compound represented by Formula (I):

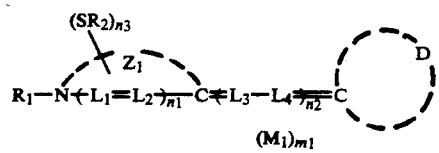

(I)

wherein $R_1$ represents an alkyl group; $R_2$ represents an alkyl group, an aryl group or a heterocyclic group; $L_1$, $L_2$, $L_3$ and $L_4$ each represents a methine group; $Z_1$ represents a group of atoms necessary to form a 5- or 6-membered nitrogen-containing heterocyclic ring; $n_1$ represents 0 or 1; $n_2$ represents 0 or an integer of 1 to 4; $n_3$ represents an integer of 1 to 10; D represents a group of atoms necessary to form an acidic nucleus; $M_1$ represents a charge-neutralizing ion; and $m_1$ represents a number of 0 or more which is necessary to neutralize a charge contained in the compound.

DETAILED DESCRIPTION OF THE INVENTION

The present invention will be explained below in more detail.

There can be given as $R_1$, preferably an unsubstituted alkyl group having 18 or less carbon atoms (for example, methyl, ethyl, propyl, butyl, pentyl, octyl, decyl, dodecyl, and octadecyl), and a substituted alkyl group [an alkyl group having 18 or less carbon atoms, which is substituted with, for example, a carboxy group, a sulfo group, a cyano group, a halogen atom (for example, fluorine, chlorine and bromine), a hydroxy group, an alkoxycarbonyl group having 8 or less carbon atoms (for example, methoxycarbonyl, ethoxycarbonyl, phenoxycarbonyl, and benzyloxycarbonyl), an alkoxy group having 8 or less carbon atoms (for example, methoxy, ethoxy, benzyloxy, and phenethyloxy), a monocyclic aryl oxy group having 10 or less carbon atoms (for example, phenoxy and p-tolyloxy), an acyloxy group having 3 or less carbon atoms (for example, acetyloxy and propionyloxy), an acyl group having 8 or less carbon atoms (for example, acetyl, propionyl, benzoyl and mesyl), a carbamoyl group (for example, carbamoyl, N,N-dimethylcarbamoyl, morpholinocarbonyl, and piperidinocarbonyl), a sulfamoyl group (for example, sulfamoyl, N,N-dimethylsulfamoyl, morpholinosulfonyl, and piperidinosulfonyl), and an aryl group having 10 or less carbon atoms (for example, phenyl, 4-chlorophenyl, 4-methylphenyl, and α-naphthyl)].

More preferred as $R_1$ are an unsubstituted alkyl group (for example, methyl, ethyl, n-propyl, n-butyl, n-pentyl, and n-hexyl), a carboxyalkyl group (for example, 2-carboxyethyl and carboxymethyl), and a sulfoalkyl group (for example, 2-sulfoethyl, 3-sulfopropyl, 4-sulfobutyl, and 3-sulfobutyl).

There can be given as $R_2$, preferably an alkyl group having 18 or less carbon atoms (for example, methyl, ethyl, propyl, isopropyl, butyl, isobutyl, hexyl, octyl, dodecyl, and octadecyl), an aryl group having 18 or less carbon atoms (for example, phenyl, 2-naphthyl, and 1-naphthyl), and a heterocyclic group having 18 or less carbon atoms (for example, 2-pyridyl, 2-thiazolyl, and 2-furyl). These $R_2$ substituents may be further substituted. There can be given as such substituents, for example, a carboxy group, a sulfo group, a cyano group, a nitro group, a halogen atom (for example, fluorine, chlorine, iodine and bromine), a hydroxy group, an alkoxy group having 8 or less carbon atoms (for example, methoxy, ethoxy, benzyloxy, and phenethyloxy), an aryloxy group having 15 or less carbon atoms (for example, phenoxy), an acyloxy group having 8 or less carbon atoms (for example, acetyloxy), an acyl group having 8 or less carbon atoms, a sulfamoyl group, a carbamoyl group, an alkanesulfonylaminocarbonyl group having 8 or less carbon atoms (for example, methanesulfonylaminocarbonyl), an acylaminosulfonyl group having 8 or less carbon atoms (for example, acetylaminosulfonyl), an aryl group having 15 or less carbon atoms (for example, phenyl, 4-methylphenyl, 4-chlorophenyl, and α-naphthyl), and a heterocyclic group having 15 or less carbon atoms (for example, pyrrolidine-2-one-1-yl, tetrahydrofurfuryl, and 2-morpholino). These may be further substituted by the above substituents.

Further preferred as $R_2$ is a substituted or unsubstituted alkyl group having 1 to 4 carbon atoms, and particularly preferred is methyl or ethyl.

$L_1$ to $L_4$ each represent a methine group or a substituted methine group [for example, a methine group substituted with a substituted or unsubstituted alkyl group (for example, methyl, ethyl, and 2-carboxyethyl), a substituted or unsubstituted aryl group (for example, phenyl and o-carboxyphenyl], a heterocyclic group (for example, a barbituric acid group), a halogen atom (for example, chlorine and bromine), an alkoxy group (for example, methoxy and ethoxy), an amino group (for example, N,N-diphenylamino, N-methyl-N-phenylamino, and N-methylpiperadino), and an alkylthio group (for example, methylthio and ethylthio)]. Further, they may form a ring with the other methine groups or form a ring with an auxochrome.

There can be give as the nuclei formed by $Z_1$, a thiazole nucleus such as a thiazole nucleus (for example, thiazole, 4-methylthiazole, 4-phenylthiazole, 4,5-dimethylthiazole, and 4,5-diphenylthiazole), a benzothiazole nucleus (for example, benzothiazole, 4-chlorobenzothiazole, 5-chlorobenzothiazole, 6-chlorobenzothiazole, 5-nitrobenzothiazole, 4-methylbenzothiazole, 5-methylthiobenzothiazole, 5-methylbenzothiazole, 6-methylbenzothiazole, 5-bromobenzothiazole, 6-bromobenzothiazole, 5-iodobenzothiazole, 5-phenylbenzothiazole, 5-methoxybenzothiazole, 6-methoxybenzothiazole, 6-methylthiobenzothiazole, 5-ethoxybenzothiazole, 5-ethoxycarbonylbenzothiazole, 5-carboxybenzothiazole, 5-phenethylbenzothiazole, 5-fluorobenzothiazole, 5-chloro-6-methylbenzothiazole, 5,6-dimethylbenzothiazole, 5,6-dimethylthiobenzothiazole, 5,6-dimethoxybenzothiazole, 5-hydroxy-6-methylbenzothiazole, tetrahydrobenzothiazole, and 4-phenylbenzothiazole), and a naphthothiazole nucleus (for example, naphtho[2,1-d]thiazole, naphtho[1,2-d]thiazole, naphtho[2,3-d]thiazole, 5-methoxynaphtho[1,2-d]thiazole, 7-ethoxynaphtho[2,1-d]thiazole, 8-methoxynaphtho[2,1-d]thiazole, and 5-methoxynaphtho[2,3-d]thiazole); a thiazoline nucleus (for example, thiazoline, 4-methylthiazoline and 4-nitrothiazoline); an oxazole nucleus such as an oxazole nucleus (for example, oxazole, 4-methyloxazole, 4-nitroxazole, 5-methyloxazole, 4-phenyloxazole, 4,5-diphenyloxazole, and 4-ethyloxazole), a benzoxazole nucleus (for example, benzoxazole, 5-chlorobenzoxazole, 5-methylbenzoxazole, 5-bromobenzoxazole, 5-fluorobenzoxazole, 5-phenylbenzoxazole, 5-methoxybenzoxazole, 5-nitrobenzoxazole, 5-trifluoromethylbenzoxazole, 5-hydroxybenzoxazole, 5-carboxybenzoxazole, 6-methylbenzoxazole, 6-chlorobenzoxazole, 6-nitrobenzoxazole, 6-methoxybenzoxazole, 6-hydroxybenzoxazole, 5,6-dimethylbenzoxazole, 4,6-dimethylbenzoxazole, and 5-ethoxybenzoxazole), and a naphthoxazole nucleus (for example, naphtho[2,1-d]oxazole, naphtho[1,2-d]oxazole, naphtho[2,3-d]oxazole, and 5-nitronaphtho[2,1-d]oxazole); an oxazoline nucleus (for example, 4,4-dimethyloxazoline); a selenazole nucleus such as selenazole nucleus (for example, 4-methylseleneazole, 4-nitroselanazole, and 4-phenylselenazole), a benzoselenazole nucleus (for example, benzoselenazole, 5-cholorobenzoselenazole, 5-nitrobenzoselenazole, 5-methoxybenzoselenazole, 5-hydroxybenzoselenazole, 6-nitrobenzoselenazole, 5-chloro-6-nitrobenzoselenazole, and 5,6-dimethylbenzoselenazole), and a naphthoselenazole nucleus (for example, naphtho[2,1-d]selenazole and naphtho[1,2-d]-selenazole); a selenazoline nucleus (for example, selenazoline and 4-methylselenazoline); a tellurazole nucleus such as a tellurazole nucleus (for example, tellurazole, 4-methyltellurazole, and 4-phenyltellurazole), a benzotellurazole nucleus (for example, benzotellurazole, 5-chlorobenzotellurazole, 5-methylbenzotellurazole, 5,6-dimethylbenzotellurazole, and 6-methoxybenzotellurazole), and a naphthotellurazole nucleus (for example, naphtho[2,1-d]tellurazole and naphtho[1,2-d]tellurazole); a tellurazoline nucleus (for example, tellurazoline and 4-methyltellurazoline); a 3,3-dialkylindolenine nucleus (for example, 3,3-dimethylindolenine, 3,3-diethylindolenine, 3,3-dimethyl5-cyanoindolenine, 3,3-dimethyl-6-nitroindolenine, 3,3-dimethyl-5-nitroindolenine, 3,3-dimethyl-5-methoxyindolenine, 3,3,5-trimethylindolenine, and 3,3-dimethyl-5-chloroindolenine); an imidazole nucleus such as an imidazole nucleus (for example, 1-alkylimidazole, 1-alkyl-4-phenylimidazole, and 1-arylimidazole), a benzimidazole nucleus (for example, 1-alkylbenzimidazole, 1-alkyl-5-chlorobenzimidazole, 1-alkyl-5,6-dichlorobenzimidazole, 1 alkyl-5-methoxybenzimidazole, 1-alkyl-5-cyanobenzimidazole, 1-alkyl-5-fluorobenzimidazole, 1-alkyl-5-trifluoromethylbenzimidazole, 1 alkyl-6-chloro-5-cyanobenzimidazole, 1-alkyl-6-chloro-5-trifluoromethylbenzimidazole, 1-allyl-5,6-dichlorobenzimidazole, 1 allyl-5-chlorobenzimidazole, 1-arylbenzimidazole, 1-aryl-5-chlorobenzimidazole, 1-aryl-5,6-dichlorobenzimidazole, 1-aryl-5-methoxybenzimidazole, and 1-aryl-5-cyanobenzimidazile), and a naphthoimidazole nucleus (for example, 1-alkylnaphtho[1,2-d]imidazole and 1-arylnaphtho[1,2-d]imidazole), in which preferred as the above alkyl group is an alkyl group having 1 to 8 carbon atoms, for example, a non-substituted alkyl group such as methyl, ethyl, propyl, isopropyl and butyl, and a hydroxalkyl group (for example, 2-hydroxyethyl and 3-hydroxypropyl), particularly preferred are methyl and ethyl, and the above aryl group represents a phenyl, phenyl substituted with a halogen atom (for example, chlorine), phenyl substituted with an alkyl group (for example, methyl), and phenyl substituted with an alkoxy group (for example, methoxy); a pyridine nucleus (for example, 2-pyridine, 4-pyridine, 5-methyl-2-pyridine, and 3-methyl-4-pyridine); a quinoline nucleus such as a quinoline nucleus (for example, 2-quinoline, 3-methyl-2-quinoline, 5-ethyl-2quinoline, 6-methyl-2-quinoline, 6-nitro-2-quinoline, 8-fluoro-2-quinoline, 6-methoxy-2-quinoline, 6-hydroxy-2-quinoline, 8-chloro-2-quinoline, 4-quinoline, 6-ethoxy-4-quinoline, 6-nitro-4-quinoline, 8-chloro-4-quinoline, 8-fluoro-4-quinoline, 8-methyl-4-quinoline, 8-methoxy-4-quinoline, 6-methyl-4-quinoline, 6-methoxy-4-quinoline, and 6-chloro-4-quinoline), and an isoquinoline nucleus (for example, 6-nitro-1-isoquinoline, 3,4-dihydro-1-isoquinoline, and 6-nitro-3-isoquinoline); an imidazo[4,5-b]quinoxaline nucleus (for example, 1,3-diethylimidazo[4,5-b]quinoxaline and 6-chloro-1,3-diallylimidazo[4,5-b]quinoxaline); an oxadiazole nucleus; a thiadiazole nucleus; a tetrazole nucleus; and a pyrimidine nucleus.

Preferred as the nuclei formed by $Z_1$ are a benzothiazole nucleus, a naphthothiazole nucleus, a benzoxazole nucleus, a naphthoxazole nucleus, a benzimidazole nucleus, a 2-quinoline nucleus, and a 4-quinoline nucleus.

$Z_1$ may be substituted with $—SR_2$ and may further be substituted with the other substituents.

Particularly preferred as $Z_1—(SR_2)_{n3}$ is a 5,6-dimethylthiobenzothiazole nucleus.

D represents a group of atoms necessary to form an acidic nucleus and can have the form of an acidic nucleus of any conventional merocyanine dye. The acidic nucleus called herewith is described in, for example, *The Theory of the Photographic Process* edited by T. H. James, fourth edition, Chapter 8, pp. 198 to 200, published by Macmillan Co., Ltd. (1977).

In a preferred form, D can have a substituent related to the resonance form of the acidic nucleus represented by D, for example, a carbonyl group, a cyano group, a sulfonyl group, and a sulfinyl group.

When the acidic nucleus is non-cyclic, at the terminal part of the methine chain to which the acidic nucleus is attached is a group such as malononitrile, alkanesulfonyl acetonitrile, cyanomethylbenzofuranyl ketone, or cyanomethylphenyl ketone.

When D is cyclic, it forms a 5- or 6-membered heterocyclic ring comprising a carbon atom, a nitrogen atom and a chalcogen atom (typically, an oxygen atom, a sulfur atom, a selenium atom or a tellurium atom). There can be preferably given the following nuclei: 2-pyrazoline-5-one, pyrazolidine-3,5-dione, imidazoline-5-one, hydantoin, 2- or 4-thiohydantoin, 2-iminoxazolidine-4-one, 2-oxazoline-5-one, 2-thioxazolidine 2,4-dione, isoxazoline-5-one, 2-thiazoline-4-one, thiazolidine-4-one, thiazolidine-2,4-dione, rhodanine, thiazolidine-2,4-dithione, isorhodanine, indan-1,3-dione, thiophene-3-one, thiophene-3-one-1,1-dioxide, indoline-2-one, indoline-3-one, indazoline-3-one, 2-oxoindazolinium, 3-oxoindazolinium, 5,7-dioxo-6,7-dihydrothiazolo[3,2-a]pyrimidine, cyclohexane-1,3-dione, 3,4-dihydroisoquinoline-4-one, 1,3-dioxane-4,6-dione, barbituric acid, 2-thiobarbituric acid, chroman-2,4-dione, indazoline-2-one, and pyrido[1,2-a]pyrimidine-1,3-dione.

Further preferred as D are rhodanine, 2-thioxazolidine-2,4-dione, and 2-thiohydantoin.

The substituents connected to the nitrogen atoms contained in the acidic nuclei are preferably a hydrogen atom, an alkyl group having 1 to 18 carbon atoms, preferably 1 to 7 carbon atoms, and particularly preferably 1 to 4 carbon atoms (for example, methyl, ethyl, propyl, isopropyl, butyl, isobutyl, hexyl, octyl, dodecyl, octadecyl), a substituted alkyl group [for example, an aralkyl group (for example, benzyl and 2-phenylethyl), a hydroxyalkyl group (for example, 2-hydroxyethyl and 3-hydroxypropyl), a carboxyalkyl (for example, 2-carboxyethyl, 3-carboxypropyl, 4-carboxybutyl, and carboxymethyl), an alkoxyalkyl group (for example, 2-methoxyethyl and 2-(2-methoxyethoxy)ethyl), a sulfoalkyl group (for example, 2-sulfoethyl, 3-sulfopropyl, 3-sulfobutyl, 4-sulfobutyl, 2-(3-sulfopropoxy)ethyl, 2-hydroxy-3-sulfopropyl, and 3-sulfopropoxyethoxyethyl), a sulfatoalkyl group (for example, 3-sulfatopropyl and 4-sulfatobutyl), a heterocycle-substituted alkyl group (for example, 2-(pyrrolidine-2-one-1-yl)ethyl, tetrahydrofurfuryl, and 2-morpholinoethyl), 2-acetoxyethyl, carbomethoxymethyl, and 2-methanesulfonylaminoethyl], an allyl group, an aryl group (for example, phenyl and 2-naphthyl), a substituted aryl group (for example, 4-carboxyphenyl, 4-sulfophenyl, 3-chlorophenyl, and 3-methylphenyl), and a heterocyclic group (for example, 2-pyridyl and 2-thiazolyl).

Further preferred are an unsubstituted alkyl group (for example, methyl, ethyl, n-propyl, n-butyl, n-pentyl, and n-hexyl), a carboxyalkyl group (for example, carboxymethyl and 2-carboxyethyl), and a sulfoalkyl group (for example, 2-sulfoethyl).

$n_1$ represents 0 or 1. $n_2$ is preferably 0 or an integer of 1 to 3, more preferably 2 or 3. $n_3$ is preferably an integer of 1 to 6, more preferably an integer of 1 to 4, and particularly 1 or 2.

$(M_1)_{m1}$ is included in the formula in order to show the presence or absence of a cation or an anion to the extent necessary to offset an ion charge of a dye. The auxochrome and the substituents of the dye determine whether the dye is cationic or anionic or possesses a net ion charge. Typical cations are an inorganic or organic ammonium ion (for example, a triethylammonium ion and a pyridium ion) and an alkali metal ion (for example, a sodium ion and a potassium ion). The anion may be either an inorganic anion or an organic anion, for example, a halogen anion (for example, a fluorine ion, a chlorine ion, a bromine ion, and an iodine ion), a substituted arylsulfonic acid ion (for example, a p-toluenesulfonic acid ion and a p-chlorobenzenesulfonic acid ion), an aryldisulfonic acid ion (for example, a 1,3-benzenedisulfonic acid ion, a 1,5-naphthalenedisulfonic acid ion, and a 2,6-naphthalenedisulfonic acid ion), an alkylsulfuric acid ion (for example, a methylsulfuric acid ion), a sulfuric acid ion, a thiocyanic acid ion, a perchloric acid ion, a tetrafluoroboric acid ion, a picric acid ion, an acetic acid ion, and a trifluoromethanesulfonic acid ion.

Preferred are an ammonium ion (for example, a triethylammonium ion and a pyridium ion), an alkali metal ion (for example, a sodium ion and a potassium ion), an iodine ion, and a p-toluenesulfonic acid ion.

Spectral sensitizing dyes can be used in addition to the compounds of Formula (I), for instance a cyanine dye, a merocyanine dye, and a complex merocyanine dye. In addition thereto, there are used a complex cyanine dye, a holopolar cyanine dye, a hemicyanine dye, a styryl dye, and a hemioxonol dye. The cyanine dye may be a simple cyanine dye, a carbocyanine dye, a dicarbocyanine dye, or a tricarbocyanine dye.

The typical examples of the methine compound represented by Formula (I) are given below, but the formula is not limited thereto:

(Me = $CH_3$, Et = $C_2H_5$, Prs = $(CH_2)_3SO_3^-$, Bus = $(CH_2)_4SO_3^-$, Ph = 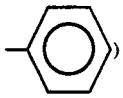 )
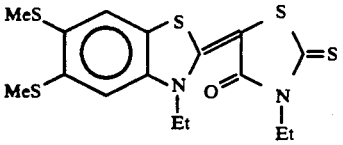
(1)
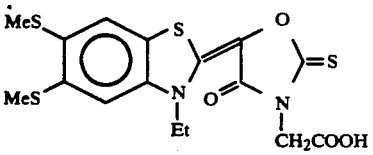
(2)
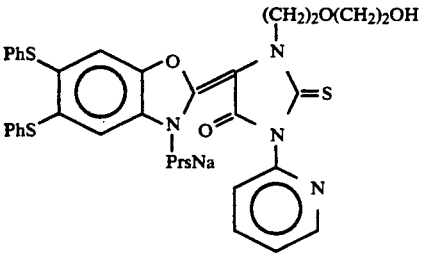
(3)
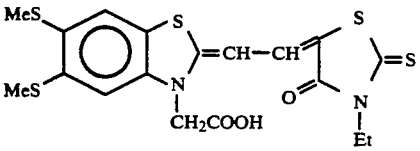
(4)
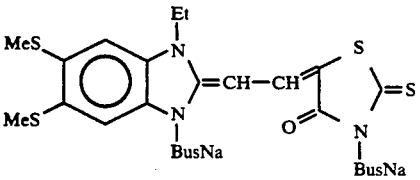
(5)
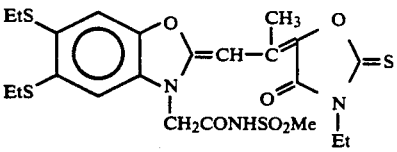
(6)
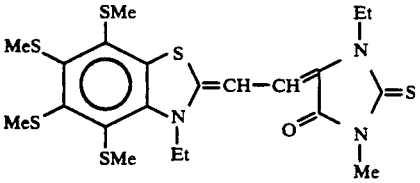
(7)
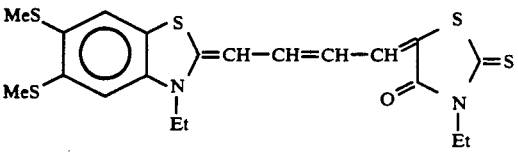
(8)

-continued
(9)
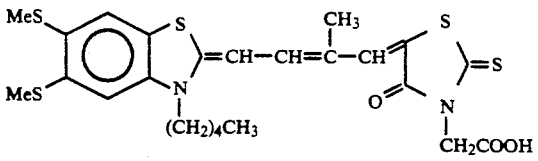
(10)
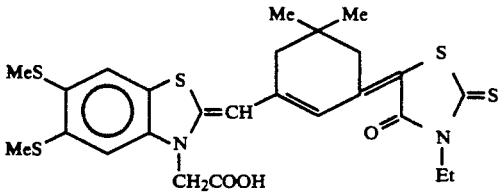
(11)
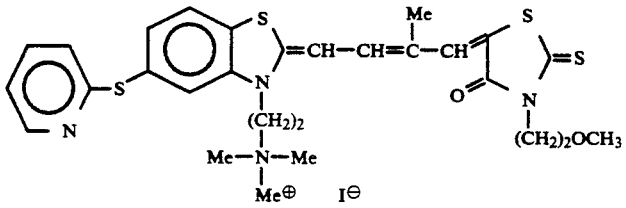
(12)
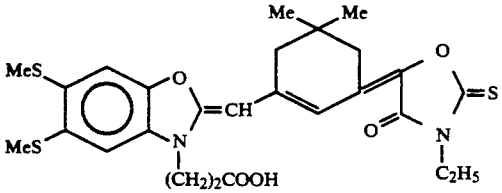
(13)
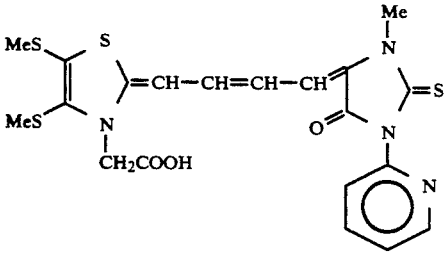
(14)
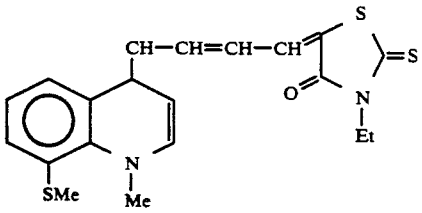
(15)
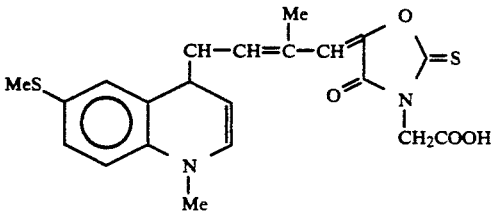
(16)
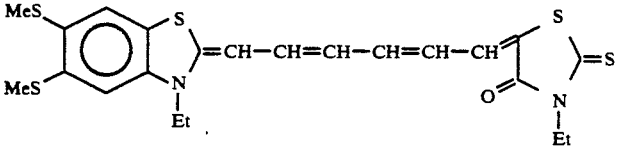

-continued
(17)
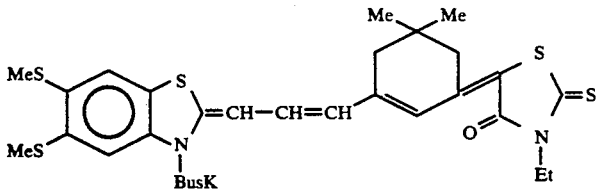
(18)
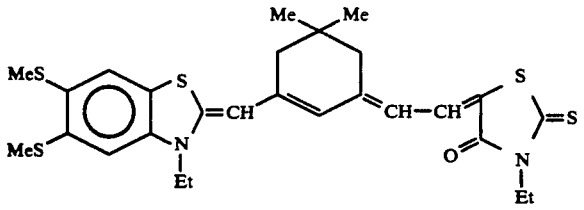
(19)
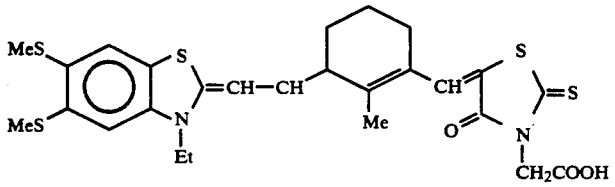
(20)
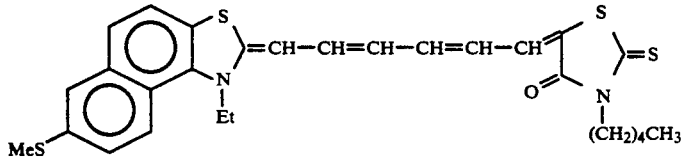
(21)
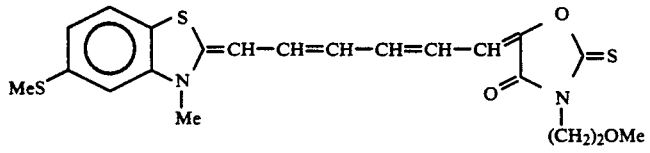
(22)
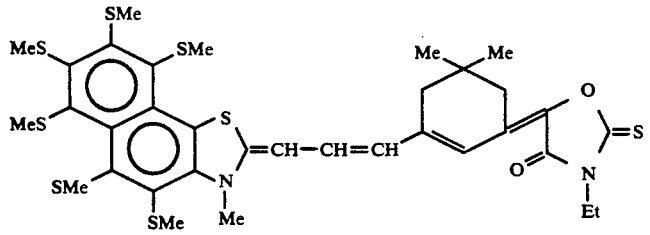
(23)
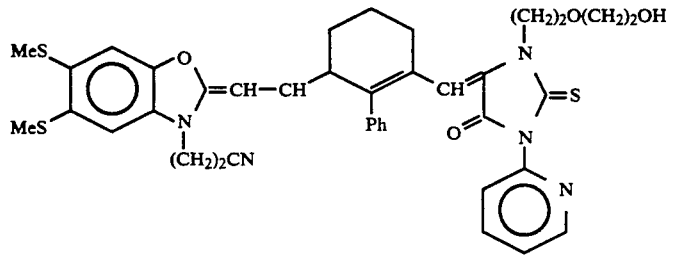

-continued
(24)
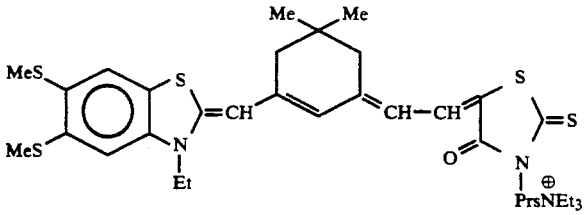
(25)
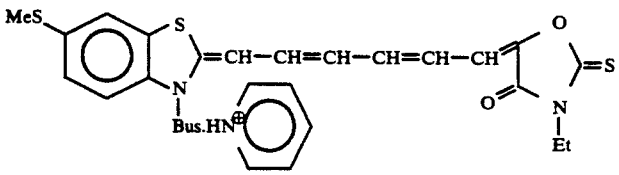
(26)
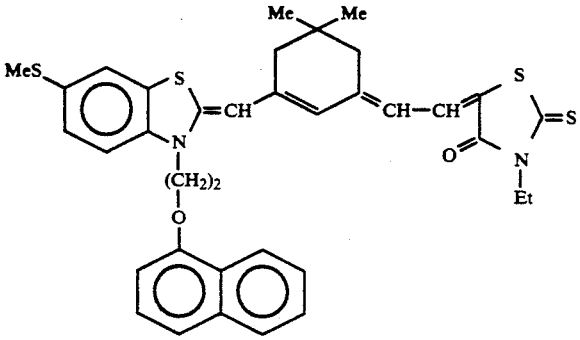
(27)
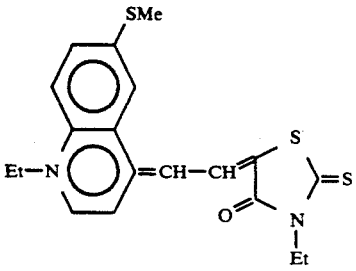
(28)
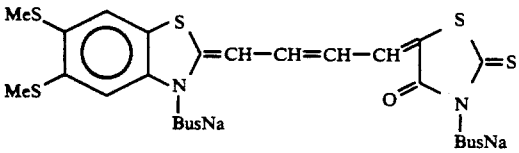
(29)
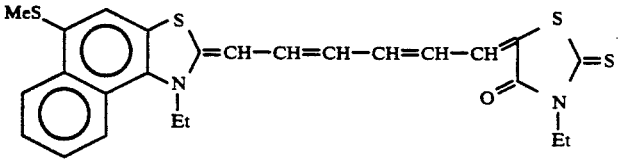
(30)
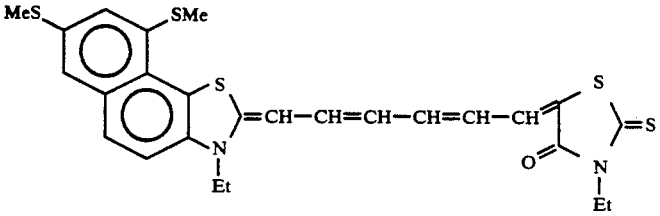

-continued

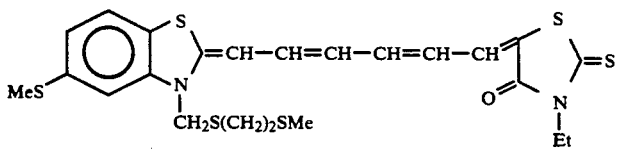

(31)

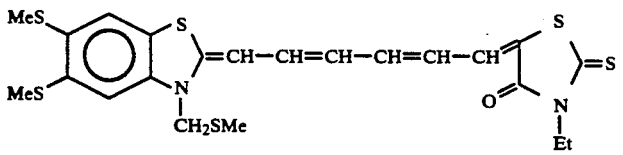

(32)

A heterocyclic ring having a methylthio group, which is the raw material for synthesizing the compounds represented by Formula (I) according to the present invention, can be synthesized according to the method described in U.S. Pat. No. 4,975,362. The compounds and methods disclosed in that patent are incorporated herein by reference.

The compounds represented by Formula (I) in the present invention can be synthesized according to the methods described in the following publications: a) "Heterocyclic Compounds-Cyanine Dyes and Related Compounds" written by F. M. Harmer, published by John Wiley & Sons Co., Ltd. (New York, London) 1964; b) "Heterocyclic Compounds-Special Topics in Heterocyclic Chemistry" written by D. M. Sturmer, Chapter 8, Section 4, pp. 482 to 515, published by John Wiley & Sons Co., Ltd. (New York, London) 1977.

The silver halide emulsion which can be used in the present invention may contain silver bromide, silver bromoiodide, silver bromochloroiodide, silver bromochloride, or silver chloride.

As tabular grains, preferred are tabular grains in which grains having a thickness of 0.5 μm or less, preferably 0.3 μm or less, a diameter of preferably 0.6 μm or more, and an average aspect ratio of 5 or more account for 50% or more of the whole projected area of the grains.

The silver halide grains used in the present invention may have a structure in which the composition of the inside thereof is different from that of the surface portion, or a structure in which the composition is uniform throughout the grains. Also, they may be grains in which a latent image is formed primarily on the surface thereof (for example, a negative type emulsion), or grains in which the latent image is formed primarily in the inside thereof (for example, an inner latent image type emulsion).

The silver halide emulsions preferred in the present invention will be explained in detail below.

There can be preferably used as the silver halide emulsion in the present invention, emulsions comprising silver bromochloride or silver chloride each containing substantially no silver iodide, (wherein the term "containing substantially no silver iodide" means that the content of silver iodide is 1 mol % or less, preferably 0.2 mol % or less). The halide composition of the emulsion may be different by grain or the same through the grains. The use of the emulsion having the same composition through the grains makes it easy to homogenize the quality of each grain.

With respect to the halide distribution in the inside of the silver halide grains, one may select (1) grains of a so-called uniform structure in which any portion of a silver halide grain is of the same composition, (2) grains of a so-called multi-layer structure in which the halide composition of a core in the inside of the silver halide grain is different from that of a shell (a single layer or plural layers) surrounding the core, or (3) grains of a structure having a non-layer portion with a different halide composition in the inside of the grain or on the surface thereof (where the non-layer portion is present on the surface of the grain, the portion with a different halide composition is conjunctioned at an edge, corner or surface of the grain). In order to obtain a high sensitivity, either of the latter two structures is favorably used rather than the grains of a uniform structure and is preferred also from the viewpoint of their anti-pressure property. Where the silver halide grains have the above structure, there may exist a clear boundary between the portions of the different compositions, or an unclear boundary in which a mixed crystal is formed by the difference of the compositions, or a continuous structural change may be positively given.

A so-called high silver chloride emulsion having a high silver chloride content is preferably used for a light-sensitive material suited to rapid processing. In the present invention, the silver chloride content in the high silver chloride emulsion is preferably 90 mol % or more, more preferably 95 mol % or more.

In such a high silver chloride emulsion, preferred is the emulsion with a structure having layerwise or non-layerwise a silver bromide-localized phase in the inside of the silver halide grain and/or on the surface thereof. In the above localized phase, the silver bromide content is preferably at least 10 mol %, more preferably more than 20 mol %. This localized phase can be present in the inside of a grain, at an edge or corner of the grain or on a surface thereof. There can be given as one preferred example, the structure in which the localized phase is provided at the corner of the grain by an epitaxial growth.

Meanwhile, for the purpose of controlling the reduction in sensitivity to the utmost, which is caused by pressure on a light-sensitive material, the grains of a uniform structure having a narrow distribution of silver halide composition in the grains are preferably used also in the high silver chloride emulsion having a silver chloride content of 90 mol % or more.

Further, for the purpose of reducing the replenishing amount of the development processing solution, it also is effective to increase the silver chloride content in a silver halide emulsion. In such a case, an almost pure silver chloride emulsion having a silver chloride content of 98 to 100 mol % is preferably used.

The average grain size of the silver halide grains contained in the silver halide emulsion used in the present invention is preferably 0.1 to 2 μm, wherein the average grain size is defined by the number average of a grain size corresponding to the diameter of a circle having the same area as the projected area of the grain.

Further, the grain size distribution of those grains is preferably a so-called monodispersion in which the fluctuation coefficient (obtained by dividing a standard deviation in a grain size distribution with an average grain size) is 20% or less, preferably 15% or less. In this case, for the purpose of obtaining a broad latitude, the above monodisperse emulsion is preferably blended and used in the same layer, or a simultaneous coating is preferably carried out.

The silver halide grains contained in a photographic emulsion can have a regular crystal form such as cube, tetradecahedron and octahedron, an irregular crystal form such as sphere and plate, or a composite crystal form thereof. They may comprise a mixture of grains having various crystal forms. In the present invention, among them, the grains having the above regular crystal form are favorably present by 50% or more, preferably 70% or more, and more preferably 90% or more.

Further, in addition to the above, preferably used is an emulsion in which the tabular grains having an aspect ratio (circle-corresponding diameter/thickness) of 5 or more, preferably 8 or more, account for more than 50% in terms of the projected area.

The silver bromochloride emulsion used in the resent invention can be prepared by using the methods described in *Chimie et Physique Photographique* written by P. Glafkides (published by Paul Montel Co., Ltd. 1967), *Photographic Emulsion Chemistry* written by G. F. Duffin (published by The Focal Press Co., Ltd. 1966), and *Making and Coating Photographic Emulsion* written by V. L. Zelikman et al (published by The Focal Press Co., Ltd. 1964). That is, an acid method, a neutral method and an ammonia method may be used. The manner of reacting the soluble silver salt with a soluble halide may be by a single jet method, a double jet method or a combination thereof. A method of forming the silver halide grains in the presence of an excessive silver ion (a so-called reverse mixing method) can be used. There can also be used as one form of the double jet method, a method of maintaining the pAg of a solution in which silver halide is prepared at a fixed level, that is, a controlled double jet method. A silver halide emulsion consisting of the silver halide grains with a regular crystal form and an almost uniform grain size can be obtained with this method.

Various polyvalent metal ion impurities can be incorporated into the silver halide emulsion used in the present invention in the course of emulsion grain formation or physical ripening. There can be given as examples of the compounds used, the salts of cadmium, zinc, lead, copper and thallium, and the salts or complex salts of iron, ruthenium, rhodium, palladium, osmium, iridium, and platinum, each of which is an element of group VIII. In particular, the elements of group VIII can be preferably used. The addition amount of these compounds is extended over a wide range and is preferably $10^{-9}$ to $10^{-2}$ mole per mole of silver halide.

The silver halide emulsion used in the present invention is usually subjected to chemical sensitization and spectral sensitization.

As the chemical sensitization, there can be used singly or in combination, a sulfur sensitization represented by the addition of an unstable sulfur compound, a noble metal sensitization represented by a gold sensitization, or a reduction sensitization. The compounds described in a right lower column at page 18 to a right upper column at page 22 of JP-A-62-215272 (The term "JP-A" as used herein means an "unexamined published Japanese patent application") are preferably used as the compound added for the chemical sensitization.

Various compounds or precursors thereof can be added to the silver halide emulsion used in the present invention for the purpose of preventing fog or stabilizing the photographic properties during the step of preparing the light-sensitive material, storage or photographic processing. There can be preferably used as concrete examples of these compounds, those described at page 39 to page 72 of above JP-A-62-215727.

The emulsion used in the present invention is a so-called surface latent image emulsion in which a latent image is formed primarily on the surface of the grain.

Where a semiconductor laser is used as a light source for a digital exposure in the present invention, it is necessary to carry out efficiently a spectral sensitization in an infrared region.

An infrared sensitization is carried out with a sensitization by the M band of a sensitizing dye, and therefore the spectral sensitivity distribution thereof is usually broader compared with the sensitization by a J band. For this reason, a coloring layer containing a dye is preferably provided on a colloid layer farther from the support than the prescribed light-sensitive layer, to thereby revise the spectral sensitivity distribution. This coloring layer is effective in preventing color mixing with a filter effect.

In order to incorporate the sensitizing dyes represented by Formula (I) of the present invention and the other spectral sensitizing dyes into a silver halide emulsion, they may be dispersed directly into the emulsion, or they may be dissolved in a single solvent or mixed solvent such as water, methanol, ethanol, propanol, methyl cellosolve, and 2,2,3,3-tetrafluoropropanol before being added to the emulsion. Also, as described in JP-B-44-23389 (The term "JP-B" as used herein means an "examined Japanese patent publication"), JP-B-44-27555 and JP-B-57-22089, they may be dissolved in water in the presence of an acid and a base, and as described in U.S. Pat. Nos. 3,822,135 and 4,006,025, an aqueous solution or colloid dispersion which are prepared in the presence of a surface active agent may be added to the emulsion. Further, after dissolving the dyes in a solvent which is substantially immiscible with water, such as phenoxyethanol, the solution may be dispersed in water or a hydrophilic colloid before being added to the emulsion. As described in JP-A-53-102733 and JP-A-58-105141, the dispersion, which is prepared by dispersing the dyes directly in a hydrophilic colloid, may be added to the emulsion.

The timing for adding the sensitizing dyes to an emulsion may be at any step of preparing the emulsion, which has so far been known as effective. That is, it can be before grain formation of a silver halide emulsion, during the grain formation, from immediately after the grain formation to before proceeding to a washing step, before chemical sensitization, during the chemical sensitization, from immediately after chemical sensitization to solidification of the emulsion, and during the preparation of a coating solution. Most usually, it is carried out during the period from after the completion of the chemical sensitization to before coating. However, as described in U.S. Pat. Nos. 3,628,969 and 4,225,666, the dyes can be added at the same period as the chemical sensitization to simultaneously carry out the spectral and chemical sensitization. Also, as described in JP-A-58-113928, the spectral sensitization can be carried out prior to the chemical sensitization, or the spectral sensitization can be started by adding the sensitizing dyes before the completion of precipitation of silver halide grains.

Further, as taught in U.S. Pat. No. 4,225,666, a divided sensitizing dye can be added; that is, a part thereof is added prior to chemical sensitization and the remainder is added after chemical sensitization. The addition of the spectral sensitizing dyes may be at any period during the formation of the silver halide grains as well as the method taught in U.S. Pat. No. 4,183,756. Among them, particularly preferred is the addition of the sensitizing dyes before a washing step for the emulsion or before the chemical sensitization.

The addition amount of these spectral sensitizing dyes extends over a wide range according to the purpose. It preferably falls within the range of $0.5\times10^{-6}$ to $1.0\times10^{-2}$ mole, more preferably $1.0\times10^{-6}$ to $5.0\times10^{-3}$ mole, per mole of silver halide.

In a red or infrared sensitization according to the present invention, particularly effective for a sensitization by the M band is a supersensitization by the compounds described in line 3, a right lower column at page 13 to line 3 from the bottom, a right lower column at page 22 of JP-A-2-157749.

The constitution of the light-sensitive material according to the present invention will be explained.

The light-sensitive material according to the present invention has at least three silver halide emulsion layers on a support, and at least two of them preferably have a spectral sensitivity maximum in 670 nm or more. These light-sensitive layers preferably contain at least one coupler which develops a color by a coupling reaction with an oxidation product of an aromatic amine type compound. The light-sensitive material used for a full color hard copy has at least three kinds of silver halide light-sensitive layers, each having a different color sensitivity. The respective layers preferably contain a coupler which develops the yellow, magenta or cyan color by a coupling reaction with the oxidation product of an aromatic amine type compound. These three kinds of different spectral sensitivities can be selected according to the wavelength of a light source used for a digital exposure. The closest spectral sensitivity maximums are preferably apart by at least 30 nm from the viewpoint of color separation. There are no specific limitations to the corresponding relationship of the light-sensitive layers (λ1, λ2, λ3) having at least three kinds of the different spectral sensitivities with the color developing couplers (Y, M, C) contained therein. That is, the combinations of $3\times2=6$ cases are possible. Further, there are no specific limitations on the coating order of the light-sensitive layers having at least three kinds of different spectral sensitivity maximums from the support side. In some cases, a light-sensitive layer containing silver halide grains with the largest average grain size and having a spectral sensitivity in the longest wavelength is preferably provided in the uppermost position, from the viewpoint of a rapid processing. Accordingly, 36 possible combinations are available with these three kinds of different spectral sensitivities, three kinds of color developing couplers and the layer orders. The present invention can be effectively used for all of these 36 combinations of light-sensitive materials.

In the present invention, a semiconductor laser is particularly preferably used as the light source for a digital exposure. In this case, at least one of the light-sensitive layers having at least three kinds of different color sensitivities has preferably a spectral sensitivity maximum at 730 nm or more. Further, at least two layers preferably have spectral sensitivity maximums in a long wavelength region of 670 nm or more. Also in this case, there are no specific limitations on the spectral sensitivity maximum, color developing coupler and layer order. Examples of the light source for the digital exposure, spectral sensitivity maximum and color developing coupler are shown in Table 1, but the invention is not limited thereto.

TABLE 1

| | Light Source of Digital Exposure | | Color Developing | Spectral Sensitivity Maximum of Light-Sensitive Material |
|---|---|---|---|---|
| | Light Source | Wavelength | | |
| 1 | AlGaInAs (670) | 670 nm | C | 670 nm |
| | GaAlAs (750) | 750 nm | Y | 730 nm |
| | GaAlAs (810) | 810 nm | M | 810 nm |
| 2 | AlGaInAs (670) | 670 nm | Y | 670 nm |
| | GaAlAs (750) | 750 nm | M | 730 nm |
| | GaAlAs (810) | 810 nm | C | 810 nm |
| 3 | AlGaInAs (670) | 670 nm | M | 670 nm |
| | GaAlAs (750) | 750 nm | C | 750 nm |
| | GaAlAs (830) | 830 nm | Y | 830 nm |
| 4 | AlGaInAs (670) | 670 nm | Y | 670 nm |
| | GaAlAs (780) | 780 nm | M | 780 nm |
| | GaAlAs (830) | 830 nm | C | 840 nm |
| 5 | AlGaInAs (670) | 670 nm | C | 670 nm |
| | GaAlAs (780) | 780 nm | M | 780 nm |
| | GaAlAs (880) | 880 nm | Y | 880 nm |
| 6 | GaAlAs (780) | 780 nm | M | 780 nm |
| | GaAlAs (830) | 830 nm | Y | 830 nm |
| | GaAlAs (880) | 880 nm | C | 880 nm |
| 7 | GaAs (1200) + SHG 1 | 600 nm | M | 600 nm |
| 7 | AlGaInAs (670) | 670 nm | Y | 670 nm |
| | GaAlAs (880) | 750 nm | C | 750 nm |
| 8 | LED (580) | 580 nm | Y | 580 nm |
| | LED (670) | 670 nm | M | 670 nm |
| | LED (810) | 810 nm | C | 810 nm |

1) SHG: the second higher harmonics with a nonlinear optical element was used.

The exposure in the present invention will be explained. The light-sensitive material according to the present invention is preferably subjected to a scanning type digital exposure in which a high density beam ray such as a laser and LED is moved relatively to the light-sensitive material to expose an image. Accordingly, the time when silver halide in the light-sensitive material is exposed is the time necessary to expose some minute area. The minimum unit by which a quantity of light is controlled with digital data is generally used as the minute area and called a picture element. Accordingly, the exposing time changes according to the size of this picture element. The size of this picture element depends on the picture element density and a realistic range is 50 to 2000 dpi. The exposing time is preferably $10^{-4}$ second or less, more preferably $10^{-6}$ second or less, wherein the exposing time is defined by the time necessary to expose a picture element size determined by the picture element density set at 400 dpi.

In the light-sensitive material according to the present invention, for the purpose of improving sharpness, the dyes (above all, an oxonol dye) described at pages 27 to 76 of EP-A-0337490, which can be decolorized by processing, are preferably added to a hydrophilic colloid layer so that the optical reflection density in 680 nm becomes 0.70 or more, and titanium oxide which has been subjected to a surface treatment with dihydric to tetrahydric alcohol (for example, trimethylolethane) is preferably incorporated into a water resistant resin layer of the support at a ratio of 12% by weight or more (more preferably 14% by weight or more).

A colloidal silver and a dye are used for the light-sensitive material according to the present invention for the purposes of preventing an irradiation and a halation, particularly for separating the spectral sensitivity distributions in the respective light-sensitive layers and securing a safety to a safelight.

There can be given as such dye, the oxonol dyes having a pyrazolone nucleus, a barbituric nucleus or a barbituric acid nucleus, described in, for example, U.S. Pat. Nos. 506,385, 1,177,429, 1,131,884, 1,338,799, 1,385,371, 1,467,214, 1,433,102, and 1,553,516, JP-A 48-85130, JP-A-49-114420, JP-A-52-117123, JP-A-55-161233, and JP A 59-111640, JP-B-39-22069, JP-B-43-13168, and JP-B-62-273527, and U.S. Pat. Nos. 3,247,127, 3,469,985, and 4,078,933; the other oxonol dyes described in U.S. Pat. Nos. 2,533,472 and 3,379,533, British Patent 1,278,621, and JP-A-1-134447 and JP-A-1-183652; the azo dyes described in British Patents 575,691, 680,631, 599,623, 786,907, 907,125, and 1,045,609, U.S. Pat. No. 4,255,326, and JP-A-59-211043; the azomethine dyes described in JP-A-50-100116 and JP-A-54-118247, and British Patents 2,014,598 and 750,031; the anthraquinone dyes described in U.S. Pat. No. 2,865,752; the allylidene dyes described in U.S. Pat. Nos. 2,538,009, 2,688,541, and 2,538,008, British Patents 584,609 and 1,210,252, JP-A-50-40625, JP-A-51-3623, JP-A-51-10927, and JP-A-54-118247, and JP-B-48-3286 and JP-B-59-37303; the styryl dyes described in JP-B-28-3082, JP-B-44-16594, and JP-B-59-28898; the triarylmethane dyes described in British Patents 446,538 and 1,335,422, and JP-A-59-228250; the merocyanine dyes described in British Patents 1,075,653, 1,153,341, 1,284,730, 1,475,228, and 1,542,807; and the cyanine dyes described in U.S. Pat. Nos. 2,843,486 and 3,294,539, and JP-A-1-291247.

The following methods are taken in order to prevent these dyes from diffusing. For example, a ballast group is introduced into the dyes to provide an anti-diffusion property.

Also, methods are disclosed in U.S. Pat. Nos. 2,548,564, 4,124,386, and 3,625,694, in which a hydrophilic polymer having a charge opposite to that of the dissociated anion dye is included as a mordant in the layer to thereby localize the dye in a specific layer by interaction with a dye molecule.

Further, methods in which a specific layer is colored with water insoluble dye solid substances are disclosed in JP-A-56-12639, JP-A-55-155350, JP-A-55-5351, JP-A-63-27838, and JP-A-63-197943, and European Patent 15,601.

Also, methods in which a specific layer is colored with metal salt fine particles adsorbing a dye are disclosed in U.S. Pat. Nos. 2,719,088, 2,496,841, and 2,496,843, and JP-A-60-45237.

The color image preservability-improving compounds described in EP-A-0277589 are preferably used in combination with a coupler for the light sensitive material according to the present invention. In particular, they are used preferably in combination with a pyrazoloazole coupler.

That is, there are preferably used singly or in combination, compound (F) which is chemically bonded with an aromatic amine type developing agent remaining after color development processing to form a chemically inactive and substantially colorless compound and/or compound (G) which is chemically bonded with an oxidation product of the aromatic amine type developing agent remaining after color development processing to form a chemically inactive and substantially colorless compound, from the viewpoint of, for example, preventing the generation of stain and other side reactions due to the generation of colored dyes formed by the reaction of the couplers with the color developing agents or the oxidation product thereof remaining in the layers during storage after processing.

In order to prevent mold and bacteria which grow in a hydrophilic colloid layer from deteriorating an image, the anti-mold agents described in JP-A-63-271247 are preferably incorporated into the light-sensitive material according to the present invention.

There may be used as a support for the light-sensitive material according to the present invention, a white polyester type support for display, or a support provided on a support side having a silver halide emulsion layer with a layer containing a white pigment. Further, in order to improve sharpness, an anti-halation layer is preferably provided on a support side coated thereon with a silver halide emulsion layer or on the reverse side thereof. In particular, the transmitting density of the support is preferably in the range of 0.35 to 0.8 so that a display can be enjoyed with either a reflected light or a transmitted light.

An exposed light-sensitive material can be subjected to conventional black-and-white or color development processing. In the case of a color light-sensitive material, it is preferably subjected to a bleach-fixing treatment after a color development for the purpose of rapid processing. In particular, where the above high silver chloride emulsion is used, pH of a bleach fixing solution is preferably about 6.5 or less, more preferably 6 or less, for the purpose of accelerating desilvering.

Those described in the following patent publications, particularly European Patent Publication EP-A-0355660 (JP-A-1-107011), are preferably used as the silver halide emulsions and other materials (the additives) applied to the light-sensitive material according to the present invention, the photographic structural layers (a layer disposition), the methods for processing the light-sensitive material, and the additives for processing.

| Photographic element | JP-A-62-215272 | JP-A-2-33144 | EP-A-0355660 |
|---|---|---|---|
| Silver halide emulsion | p. 10, right upper column, line 6 to p. 12, left lower column, line 5, and p. 12, right lower column, line 4 from bottom to p. 13, left upper column, line 17. | p. 28, right upper column, line 16 to p. 29, right lower column, line 11, and p. 30, lines 2 to 5. | p. 45, line 53 to p. 47, line 3, and p. 47, lines 20 to 22. |
| Silver halide | p. 12, left lower column, | — | — |

-continued

| Photographic element | JP-A-62-215272 | JP-A-2-33144 | EP-A-0355660 |
|---|---|---|---|
| solvent | lines 6 to 14, and p. 13, left upper column, line 3 from bottom to p. 18, left lower column, last line. | | |
| Chemical sensitizer | p. 12, left lower column, line 3 from bottom to right lower column, line 5 from bottom, and p. 18, right lower column, line 1 to p. 22, right upper column, line 9 from bottom. | p. 29, right lower column, line 12 to last line. | p. 47, lines 4 to 9. |
| Spectral sensitizer (spectral sensitizing method) | p. 22, right upper column, line 8 from bottom to p. 38, last line. | p. 30, left upper column, lines 1 to 13. | p. 47, lines 10 to 15. |
| Emulsion stabilizer | p. 39, left upper column, line 1 to p. 72, right upper column, last line. | p. 30, left upper column, line 14 to right upper column, line 1. | p. 47, lines 16 to 19. |
| Development accelerator | p. 72, left lower column, line 1 to p. 91, right upper column, line 3. | — | — |
| Color coupler (cyan, magenta and yellow couplers) | p. 91, right upper column, line 4 to p. 121, left upper column, line 6. | p. 3, right upper column, line 14 to p. 18, left upper column, last line, and p. 30, right upper column, line 6 to p. 35 right lower column, line 11. | p. 4, lines 15 to 27, p. 5, line 30 to p. 28, last line, p. 45, lines 29 to 31, and p. 47, line 23 to p. 63, line 50. |
| Color forming accelerator | p. 121, left upper column, line 7 to p. 125, right upper column, line 1. | — | — |
| UV absorber | p. 125, right upper column, line 2 to p. 127, left lower column, last line. | p. 37, right lower column, line 14 to p. 38, left upper column, line 11. | p. 65, lines 22 to 31. |
| Anti-fading agent (an image stabilizer) | p. 127, right lower column, line 1 to p. 137, left lower column, line 8. | p. 36, right upper column, line 12 to p. 37, left upper column, line 19. | p. 4, line 30 to p. 5, line 23, p. 29, line 1 to p. 45, line 25, p. 45, lines 33 to 40, and p. 65, lines 2 to 21. |
| High boiling and/or low boiling organic solvent | p. 137, left lower column, line 9 to p. 144, right upper, last line. | p. 35, right lower column, line 14 to p. 36, left upper column, line 4. | p. 64, lines 1 to 51. |
| Method for dispersing photographic additives | p. 144, left lower column, line 1 to p. 146, right upper column, line 7. | p. 27, right lower column, line 10 to p. 28, left upper, last line, and p. 35, right lower column, line 12 to p. 36, right upper column, line 7. | p. 63, line 51 to p. 64, line 56. |
| Hardener | p. 146, right upper column, line 8 to p. 155, left lower column, line 4. | — | — |
| Precursor of a developing agent | p. 155, left lower column, line 5 to right lower column, line 2. | — | — |
| Development inhibitor-releasing compound | p. 155, right lower column, lines 3 to 9. | — | — |
| Support | p. 155, right lower column, line 19 to p. 156, left upper column, line 14. | p. 38, right upper column, line 18 to p. 39, left upper column, line 3. | p. 66, line 29 to p. 67 line 13. |
| Light-sensitive layer structure | p. 156, left upper column, line 15 to right lower | p. 28, right upper column, lines 1 to 15. | p. 45, lines 41 to 52 |
| Dye | p. 156, right lower column, line 15 to p. 184, right lower column, last line. | p. 38, left upper column, line 12 to right upper column, line 7. | p. 66, lines 18 to 22. |
| Anti-color mixing agent | p. 185, left upper column, line 1 to p. 188, right lower column, line 3. | p. 36, right upper column, lines 8 to 11. | p. 64, line 57 to p. 65 line 1. |
| Gradation controller | p. 188, right lower column, lines 4 to 8. | — | — |
| Anti-stain agent | P. 188, right lower column, line 9 to p. 193, right lower column, line 10. | p. 37, left upper column, last line to right lower column, line 13. | p. 65, line 32 to p. 66, line 17. |
| Surface active agent | p. 201, left lower column, line 1 to p. 210, right upper column, last line. | p. 18, right upper column, line 1 to p. 24, right lower column, last line, and p. 27, left lower | — |

-continued

| Photographic element | JP-A-62-215272 | JP-A-2-33144 | EP-A-0355660 |
|---|---|---|---|
| | | column, line 10 from bottom to right lower column, line 9. | |
| Fluorinated compound (anti-static agent, coating aid lubricant and anti-adhesion agent) | p. 210, left lower column, line 1 to p. 222, left lower column, line 5. | p. 25, left upper column, line 1 to p. 27, right lower column, line 9. | — — |
| Binder (hydrophilic colloid) | p. 222, left lower column, line 6 to p. 225, left upper column, last line. | p. 38, right upper column, lines 8 to 18. | p. 66, lines 23 to 28. |
| Thickener | p. 225, right upper column, line 1 to p. 227, right upper column, line 2. | — | — |
| Anti-static agent | p. 227, right upper column, line 3 to p. 230, left upper column, line 1. | — | — |
| Polymer latex | p. 230, left upper column, line 2 to p. 239, last line. | — | — |
| Matting agent | p. 240, left upper column, line 1 to right upper column, last line. | — | — |
| Photographic processing method (processing steps and additives) | p. 3, right upper column, line 7 to p. 10, right upper column, line 5. | p. 39, left upper column, line 4 to p. 42, left upper column, last line. | p. 67, line 14 to p. 69, line 28. |

Remarks:
1. There is included in the cited items of JP-A-62-215272, the content amended according to the Amendment of March 16, 1988.
2. Of the above color couplers, also preferably used as the yellow coupler are the so-called short wave type yellow couplers described in JP-A-63-231451, JP-A-63-123047, JP-A-63-241547, JP-A-1-173499, JP-A-1-213648, and JP-A-1-250944.

Preferably used as a cyan coupler are, in addition to the diphenylimidazole type cyan couplers described in JP-A-2-33144, the 3-hyroxypyridine type cyan couplers described in EP-A-0333085 [of them, particularly preferred are Coupler (42) in which 4-equivalence is converted to 2-equivalence by giving a chlorine-splitting group, Coupler (6) and Coupler (9)], and the cyclic active methylene type cyan couplers described in JP-A-64-32260 (of them, particularly preferred are Couplers 3, 8 and 34).

The processing temperature of a color developing solution which can be applied to the present invention is 20° to 50° C., preferably 30° to 45° C. The processing time is preferably substantially within 20 seconds. The less a replenishing amount is, the more preferable. It is suitably 20 to 600 ml per $m^2$ of a light-sensitive material, preferably 50 to 300 ml, more preferably 60 to 200 ml, and most preferably 60 to 150 ml, per $m^2$ of the light-sensitive material.

In the present invention, the developing time is preferably substantially within 20 seconds. "Substantially within 20 seconds" as described herewith is defined by the time lapsing from when a light-sensitive material comes into a developing solution bath until the time it gets in the next bath, and the passing time between the developing solution bath and the next bath is included therein.

Preferred pH at the washing step or the stabilizing step is 4 to 10, more preferably 5 to 8. Temperature can be variously set according to the applications and characteristics of the light-sensitive material. In general, it is 30° to 45° C., preferably 35° to 42° C. Time can be arbitrarily set, but the shorter the more preferable from the viewpoint of shortening processing time. It is preferably 10 to 45 seconds, more preferably 10 to 40 seconds.

The less the replenishing amount is, the more preferable from the viewpoint of running costs, reduction of the discharging amount and handling performance. To be concrete, the preferred replenishing amount is 0.5 to 50 times, preferably 2 to 15 times, the amount carried over from a preceding bath per a unit area of a light-sensitive material, or 300 ml or less, preferably 150 ml or less, per $m^2$ of the light-sensitive material. The replenishing may be carried out continuously or intermittently.

The solution used at the washing step and/or the stabilizing step can further be used at a preceding step. There can be given as an example thereof, a method in which the overflow of a washing water reduced by a multi-stage countercurrent system flows into a bleach-fixing bath of a preceding bath and a condensed solution is replenished to the bleach-fixing bath to thereby reduce the waste amount.

Next, the drying step which can be used in the present invention will be explained.

In order to complete an image in an ultra-rapid processing according to the present invention, the drying time is favorably 20 to 40 seconds. A means for shortening this drying time in a light-sensitive material is to reduce the amount of the hydrophilic binder such as gelatin, which makes it possible to reduce the water carried over to the layer to make the improvement. It also is possible to expedite drying by absorbing water with a squeeze roller and a cloth immediately after removal from a washing bath, from the viewpoint of reducing a carried amount. As an improvement in the drying equipment, it is possible to expedite the drying by increasing the temperature and strengthening the drying blow. Further, the drying can also be expedited by controlling the angle of the drying blow to a light-sensitive material and a method for removing a discharging blow.

EXAMPLE 1

Synthesis of Compound (8)

Synthetic scheme:

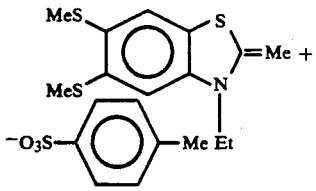

(a)

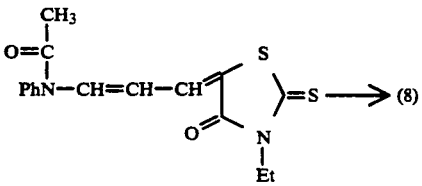

(b)

Substance (a) 0.5 g (1.13 millimole) and Substance (b) 0.38 g (1.13 millimole) were dissolved in methanol 5 ml and further, triethylamine 0.5 ml was added thereto. The reaction solution was heated for refluxing for 1 hour. After being left for cooling, the precipitated crystals were filtered out by vacuum. The crystals thus obtained were refined with a silica gel column chromatography (an eluting solution: ethyl acetate/hexane=½), and the solvent was distilled off. The crystals obtained were dissolved in chloroform (100 ml) and after a spontaneous filtration, methanol (200 ml) was added to the filtrate. The solvent in this solution was distilled off under a reduced pressure until it was reduced to 150 ml. The crystals thus obtained were filtered out by vacuum. The recrystallization of these crystals was repeated once again with chloroform/methanol. The crystals thus obtained were dried under a reduced pressure at a room temperature.

Yielding: 0.09 g
Yield: 17%
Melting point: 300° C. or higher
λmax (methanol): 614 nm
ε: $7.32\times10^4$

EXAMPLE 2

Synthesis of Compound (16)

Synthetic scheme:

(a) +

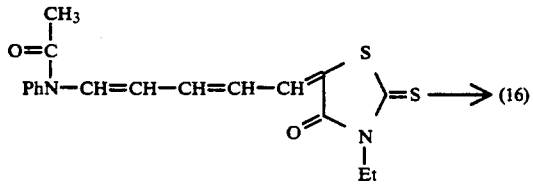

(c)

Substance (a) 1.1 g (2.5 millimole) and Substance (c) 0.8 g (2.5 millimole) were dissolved in methanol 40 ml and further, triethylamine 0.7 ml was added thereto. The reaction solution was heated for refluxing for 2 hours. After being left for cooling, the precipitated crystals were filtered out by vacuum. The crystals thus obtained were refined with a silica gel column chromatography (an eluting solution: ethyl acetate/hexane=½) and the solvent was distilled off. The crystals obtained were dissolved in chloroform (100 ml) and after a spontaneous filtration, methanol (200 ml) was added to the filtrate. The solvent in this solution was distilled off under a reduced pressure until it was reduced to 150 ml. The crystals thus obtained were filtered off by vacuum. The recrystallization of these crystals was repeated once again with chloroform/methanol. The crystals thus obtained were dried under a reduced pressure at a room temperature.

Yielding: 0.08 g
Yield: 6.5%
Melting point: 201° to 203° C.
λmax (methanol): 631 nm
ε:$4.43\times10^4$

EXAMPLE 3

The compounds shown in Table 2 were added at 40° C. to tabular silver bromoiodide emulsions (an average diameter: 0.82 μm, an average diameter/thickness: 11.2, pAg: 8.2, and pH: 6.5) which were subjected to gold and sulfur sensitizations and which were prepared according to the method disclosed in Example 1 of JP-A-60-131533. Then, sodium 2,4-dichloro-6-hydroxy-1,3,5-triazine was added as a gelatin hardener, and this solution was coated on a cellulose triacetate support to provide an emulsion layer. There was simultaneously coated on this emulsion layer, a protective layer consisting mainly of gelatin containing a surface active agent and the above gelatin hardener.

Each of the samples thus prepared was divided into three pieces. One piece was stored at −30° C., and another piece was stored under an oxygen partial pressure of 10 atm at a room temperature each for 3 days. The remaining piece was stored at −30° C. and then at 80% RH and 50° C. for 3 days prior to exposure. These three sample pieces were subjected to an exposure for a sensitometry with a sensitometer FWH (a UV absorbing filter equipment, a tungsten light source, a color temperature: 2854° K.) manufactured by Fuji Photo Film Co., Ltd., via a sharp cut filter transmitting light of a wavelength longer than 520 nm. Then, they were subjected to developing in the following developing solution, bleaching and drying after washing.

The samples thus processed were subjected to measurement of a fog density and sensitivity with a densitometer manufactured by Fuji Photo Film Co., Ltd. The sensitivity was expressed by the reciprocal of an exposure necessary to give the density obtained by adding 0.2 to the fog density. In Table 2, the sensitivities of the samples stored at −30° C. are expressed by values relative to that of Sample 2-1, which is set at 100. Also, the sensitivities of the samples stored at 80% RH and 50° C. and the samples stored under an oxygen partial pressure of 10 atm for 3 days are expressed by the values relative to that of each of the same samples stored at −30° C., which is set at 100.

| Composition of the developing solution: | |
|---|---|
| Metol | 2.5 g |
| l-Ascorbic acid | 10.0 g |
| Potassium bromide | 1.0 g |

-continued

| Composition of the developing solution: | |
|---|---|
| Nabox | 35.0 g |
| Water to make | 1.0 l |
| | (pH 9.8) |

As shown in Table 2, the increase or decrease in a sensitivity under aging is small in the present invention.

TABLE 2

| | Methine dye | | Storage A*1 | | Storage B*2 | | Storage C*3 | |
|---|---|---|---|---|---|---|---|---|
| Sample No. | Kind | Added amount*4 | Relative sensitivity | Fog | Relative sensitivity | Fog | Relative sensitivity | Fog |
| 2-1 (Comp.) | C-1 | | 100*5 | 0.03 | 85 | 0.03 | 86 | 0.03 |
| 2-2 (Comp.) | C-2 | | 105 | 0.02 | 80 | 0.02 | 81 | 0.03 |
| 2-3 (Inv.) | (27) | | 120 | 0.02 | 90 | 0.02 | 90 | 0.02 |
| 2-4 (Comp.) | C-3 | | 130 | 0.03 | 73 | 0.03 | 70 | 0.04 |
| 2-5 (Comp.) | C-4 | | 133 | 0.02 | 70 | 0.02 | 68 | 0.03 |
| 2-6 (Inv.) | (8) | | 140 | 0.02 | 88 | 0.02 | 85 | 0.03 |
| 2-7 (Comp.) | C-5 | | 140 | 0.03 | 68 | 0.03 | 65 | 0.04 |
| 2-8 (Inv.) | (9) | | 145 | 0.02 | 85 | 0.03 | 83 | 0.03 |
| 2-9 (Comp.) | C-6 | | 150 | 0.02 | 73 | 0.03 | 70 | 0.03 |
| 2-10 (Inv.) | (10) | | 153 | 0.02 | 85 | 0.03 | 86 | 0.02 |
| 2-11 (Comp.) | C-7 | | 120 | 0.02 | 62 | 0.03 | 58 | 0.02 |
| 2-12 (Comp.) | C-8 | | 130 | 0.03 | 58 | 0.04 | 57 | 0.04 |
| 2-13 (Inv.) | (16) | | 140 | 0.02 | 80 | 0.02 | 78 | 0.03 |
| 2-14 (Comp.) | C-9 | | 132 | 0.03 | 58 | 0.03 | 56 | 0.04 |
| 2-15 (Comp.) | C-10 | | 140 | 0.03 | 60 | 0.03 | 55 | 0.04 |
| 2-16 (Inv.) | (17) | | 145 | 0.03 | 80 | 0.03 | 82 | 0.03 |
| 2-17 (Comp.) | C-11 | | 143 | 0.02 | 71 | 0.04 | 65 | 0.04 |
| 2-18 (Inv.) | (18) | | 150 | 0.02 | 78 | 0.03 | 73 | 0.03 |
| 2-19 (Comp.) | C-12 | | 146 | 0.02 | 92 | 0.02 | 93 | 0.02 |
| 2-20 (Inv.) | (26) | | 151 | 0.02 | 96 | 0.02 | 97 | 0.02 |

*1stored at −30° C.
*2stored at 80% RH and 50° C.
*3stored at an oxygen partial pressure of 10 atm for 3 days.
*4unit: × $10^{-5}$ mole/mole of Ag.
*5standard

C-1

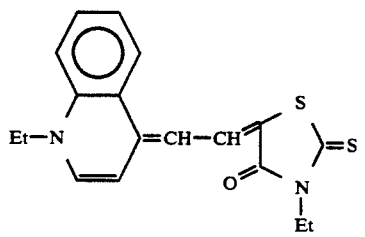

C-2

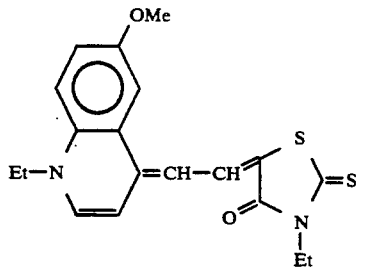

C-3

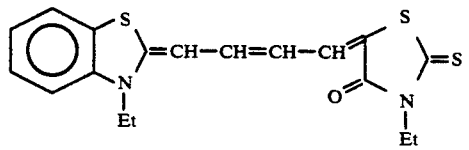

C-4

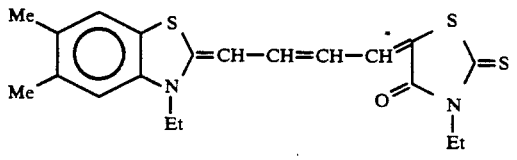

-continued
C-5
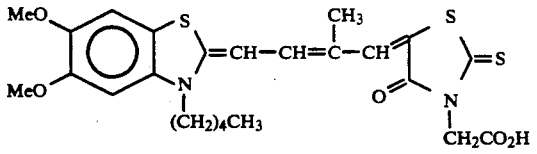
C-6
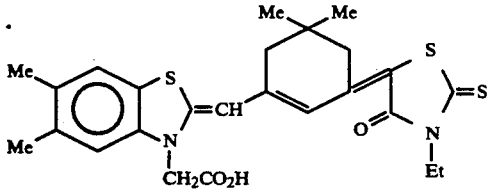
C-7
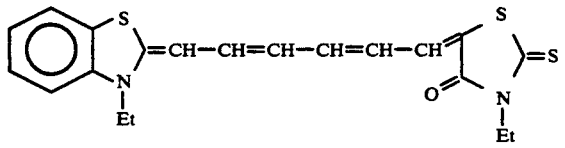
C-8
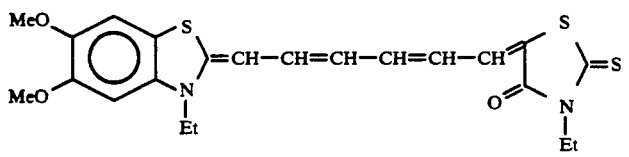
C-9
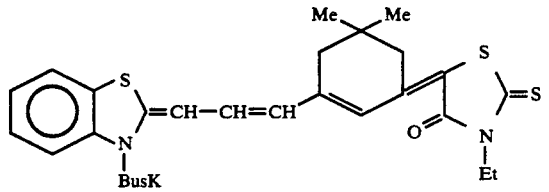
C-10
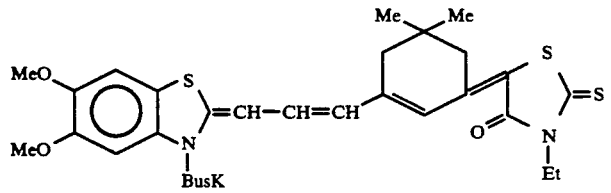
C-11
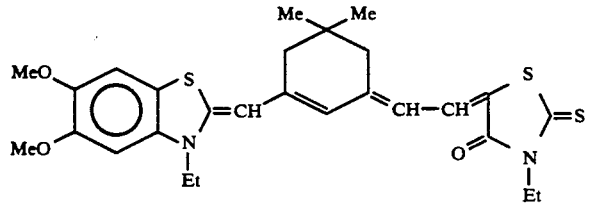

-continued

C-12

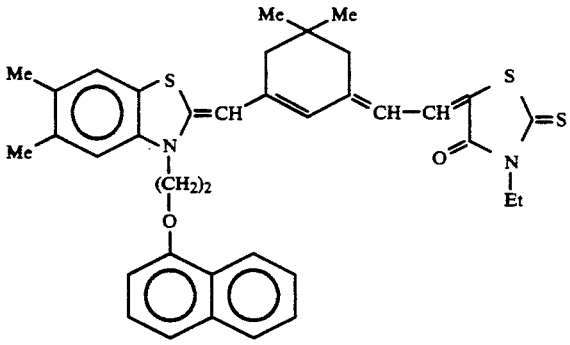

EXAMPLE 4

A cubic silver bromide emulsion was prepared according to the method disclosed in Example 1 of JP-A-1-223441. The silver bromide grains of the silver bromide emulsion thus obtained were monodisperse grains having an average side length of 0.74 μm (a fluctuation coefficient: 10.6%). This emulsion was adjusted to pH 6.3 and pAg 8.4 at 40° C., and chlorauric acid and sodium thiosulfate were added at 55° C. for ripening to thereby provide the emulsion with an optimum gold-/sulfur sensitization.

Next, the compounds shown in Table 3 were added at 40° C. Further added to the emulsion were sodium 2-hydroxy-4,6-dichloro-1,3,5-triazine 0.1 g and sodium dodecylbenzenesulfonate 0.1 g each per kg of the emulsion. Then, the emulsion was coated on a polyethylene terephthalate film base provided thereon with a protective layer in the same manner as in Example 3.

The coated samples thus prepared were divided into three pieces. One piece was stored at −30° C. and another piece at 80% RH and 50° C. for 3 days. The remaining piece was stored under an oxygen partial pressure of 10 atm at room temperature, for 3 days. Then, the samples were subjected to an exposure for a sensitometry in the same manner as in Example 3 and to a development processing to measure sensitivity. The sensitivity was expressed by a reciprocal of the exposure necessary to give the density obtained by adding 0.2 to the fog density. The results thereof are shown in Table 3, in which the sensitivities of the samples stored at −30° C. are expressed by the values relative to that of Sample 3-1, which is set at 100; also, the sensitivities of the samples stored at 80% RH and 50° C. and the samples stored under an oxygen partial pressure of 10 atm for 3 days are expressed by the values relative to that of each of the same samples stored at −30° C., which is set at 100.

TABLE 3

| Compound | | | Relative sensitivity | | |
|---|---|---|---|---|---|
| Sample No. | Kind | Added amount*4 | Storage A*1 | Storage B*2 | Storage C*3 |
| 3-1 (Comp.) | C-4 | 0.45 | 100*5 | 75 | 73 |
| 3-2 (Inv.) | (8) | 0.45 | 105 | 85 | 83 |
| 3-3 (Inv.) | (8) | 0.45 | 135 | 91 | 85 |
| | V-1 | 3.0 | | | |
| 3-4 (Comp.) | C-8 | 0.05 | 102 | 67 | 58 |
| 3-5 (Comp.) | C-8 | 0.05 | 108 | 73 | 65 |
| | V-2 | 3.0 | | | |
| 3-6 (Inv.) | (16) | 0.05 | 115 | 80 | 77 |
| 3-7 (Inv.) | (16) | 0.05 | 145 | 90 | 85 |
| | V-2 | 3.0 | | | |
| 3-8 (Comp.) | C-11 | 0.07 | 105 | 73 | 45 |
| 3-9 Comp.) | C-11 | 0.07 | 110 | 80 | 60 |
| | IV-1 | 3.4 | | | |
| 3-10 (Inv.) | (18) | 0.07 | 125 | 75 | 73 |
| 3-11 (Inv.) | (18) | 0.07 | 148 | 91 | 89 |
| | IV-1 | 3.4 | | | |

*1stored at −30° C.
*2stored at 80% RH and 50° C. for 3 days.
*3stored at an oxygen partial pressure of 10 atm for 3 days.
*4unit: × $10^{-4}$ mole/mole of Ag.
*5standard.

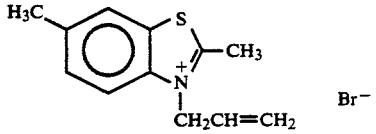

V-1

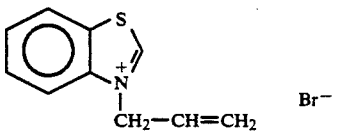

V-2

-continued

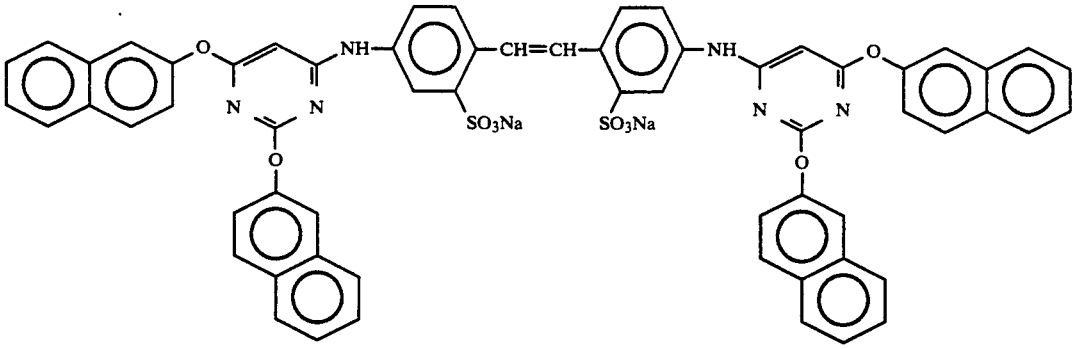

IV-1

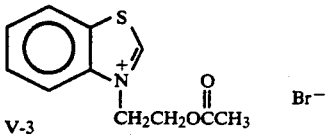

V-3

It will be understood from the results summarized in Table 3 that the samples of the present invention have a high sensitivity and show less degradation of sensitivity even under such storing conditions. Further, as is the case in Sample Nos. 3-3 and 3-7, the combined use of V-1 or V-2 with compounds of Formula (I) provides less degradation of the sensitivity obtained when they are stored under a high temperature and high humidity of 50° C. and 80% RH. In Sample No. 3-11 in which IV-1 is used in combination with a compound of Formula (I), the degradation of the sensitivity obtained when it is stored either under a high temperature and high humidity of 50° C. and 80% RH or under an oxygen partial pressure of 10 atm is further suppressed in comparison with Sample No. 3-10 to which IV-1 is not added. Also, the use of V-3 instead V-2 can provide similar results. It can be found that the effect of these compounds is demonstrated similarly with the polymethine dyes fallen outside the scope of the present invention, but the combination thereof with the polymethine dyes of the present invention markedly controls the degradation of the sensitivity even under these storing conditions.

EXAMPLE 5

An aqueous solution of $AgNO_3$ (1 kg) and an aqueous solution of KBr (161 g) and NaCl (205 g) were simultaneously added to an aqueous solution containing gelatin (72 g) and NaCl (116 g) at a constant speed for 32 minutes (Br: 23 mole%), wherein rhodium chloride and $K_3IrCl_6$ were added during 10 minutes of the first half, each in an amount of $5\times10^{-7}$ mole/mole of Ag. Then, the soluble salts were removed and gelatin was added. After adjusting pH and pAg to 6.0 and 7.5, respectively, chlorauric acid and hypo were added to provide chemical sensitization at 60° C. The time for providing the chemical sensitization was selected so that the highest sensitization could be obtained. Added to this emulsion were 4-hydroxy-6-methyl-1,3,3a,7-tetrazaindene as a stabilizer and phenoxyethanol as an antiseptic.

The emulsion thus obtained was divided into portions each 1 kg, and there were added to each portion, a 0.05% solution (110 ml) of the sensitizing dyes represented by Formula (I), a 0.5% methanol solution (60 ml) of V-1, a 0.5% methanol solution (35 ml) of V-2, and a 0.5% methanol solution (42 ml) of IV-1, as shown in Table 4. Then, there were added thereto, hydroquinone (100 mg/m$^2$), a polyethyl acrylate latex as a plasticizer in a ratio of 25% based on the gelatin binder, and 2-bis(-vinylsulfonylacetamido) ethane (85 mg/m$^2$), and the emulsion was coated on the polyester support so that a coated silver amount was 3.7 g/m$^2$ The coated amount of gelatin was 2.0 g/m$^2$.

There was provided thereon a protective layer containing gelatin (0.8 g/m$^2$), polymethyl methacrylate (40 mg/m$^2$) having an average particle size of 2.5 μm as a matting agent, colloidal silica (30 mg/m$^2$) having an average particle size of 4 μm, silicone oil (80 mg./m$^2$), sodium dodecylbenzenesulfonate (80 mg/m$^2$) as a coating aid, a surface active agent with the following structural formula (1), a polyethyl acrylate latex (150 mg/m$^2$), and potassium 1,1'- bisulfobutyl-3,3,3',3'-tetramethyl-5,5'-disulfoindotricarbocyanine (6 mg./m$^2$).

The back layer and back protective layer, each having the following composition, were provided on the support side opposite to the emulsion layer.

| | |
|---|---|
| Back layer | |
| Gelatin | 2.4 g/m$^2$ |
| Sodium dodecylbenzenesulfonate | 60 mg/m$^2$ |
| Dye (2) | 80 mg/m$^2$ |
| Dye (3) | 30 mg/m$^2$ |
| Potassium 1,1'-disulfobutyl-3,3,3', 3'-tetramethyl-5,5'-disulfoindotricarbocyanine | 80 mg/m$^2$ |
| 1,3-Divinylsulfonyl-2-propanol | 60 mg/m$^2$ |
| Potassium polyvinyl-benzenesulfonate | 30 mg/m$^2$ |
| Back protective layer | |
| Gelatin | 0.75 mg/m$^2$ |
| Polymethyl methacrylate (an average particle size: 3.5 μm) | 40 mg/m$^2$ |
| Sodium dodecylbenzenesulfonate | 20 mg/m$^2$ |
| Surface active agent (1) | 2 mg/m$^2$ |
| Silicone oil | 100 mg/m$^2$ |
| Surfactant (1) $C_8F_{17}SO_2N(C_3H_7)—CH_2COOK$ | |
| Dye (2) | |

-continued

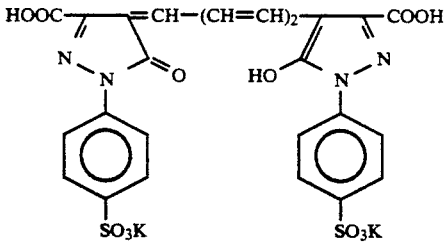

Dye (3)

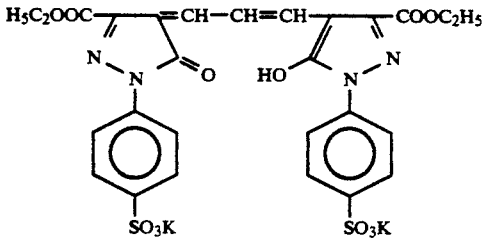

Each of the samples thus prepared was divided into three pieces. One piece was stored at −30° C., and another piece was stored under an oxygen partial pressure of 10 atm at room temperature, both for 3 days. The remaining piece was stored at −30° C. and then at 80% RH and 50° C. for 3 days prior to exposure. Then, these three sample pieces were subjected to a scanning exposure with a semiconductor laser having an emission in 780 nm. Next, the sample pieces were subjected to developing and fixing with an automatic development processing machine FG-310 PTS manufactured by Fuji Photo Film Co., Ltd., in the developing solution and fixing solution of the following compositions, followed by washing and drying, to carry out a sensitometry. The development processing was carried out at 38° C. for 14 seconds.

The sensitivity is expressed by the reciprocal of the exposure necessary to give a density of 3.0. In Table 4, the sensitivities of the samples stored at −30° C. are expressed by the values relative to that of Sample 4-1, which is set at 100; and also, the sensitivities of the samples stored at 80% RH and 50° C. and the samples stored under an oxygen partial pressure of 10 atm for 3 days are expressed by the values relative to that of each of the same samples stored at −30° C., which is set at 100.

| | |
|---|---|
| Composition of the developing solution | |
| Water | 720 ml |
| Disodium ethylenediaminetetracetate | 4 g |
| Sodium hydroxide | 44 g |
| Sodium sulfite | 45 g |
| 2-Methylimidazole | 2 g |
| Sodium carbonate | 26.4 g |
| Boric acid | 1.6 g |
| Potassium bromide | 1 g |
| Hydroquinone | 36 g |
| Diethylene glycol | 39 g |
| 5-Methyl-benzotriazole | 0.2 g |
| Pyrazolone | 0.7 g |
| Water to make | 1 liter |
| Composition of the fixing solution | |
| Ammonium thiosulfate | 170 g |
| Sodium sulfite anhydrous | 15 g |
| Boric acid | 7 g |
| Glacial acetic acid | 15 ml |
| Potassium alum | 20 g |
| Ethylenediaminetetracetic acid | 0.1 g |
| Tartaric acid | 3.5 g |
| Water to make | 1 liter |

TABLE 4

| | Methine dye | | Storage A*1 | | Storage B*2 | | Storage C*3 | |
|---|---|---|---|---|---|---|---|---|
| Sample No. | Kind | Added amount*4 | Relative Sensitivity | Fog | sensitivity | Fog | Relative sensitivity | Fog |
| 4-1 (Comp.) | C-7 | | 100*5 | 0.03 | 65 | 0.03 | 59 | 0.04 |
| 4-2 (Comp.) | C-8 | | 105 | 0.02 | 59 | 0.02 | 61 | 0.02 |
| 4-3 (Inv.) | (16) | | 111 | 0.02 | 83 | 0.02 | 75 | 0.02 |
| 4-4 (Comp.) | C-13 | | 116 | 0.03 | 66 | 0.03 | 68 | 0.04 |
| 4-5 (Inv.) | (19) | | 121 | 0.02 | 80 | 0.02 | 85 | 0.02 |
| 4-6 (Comp.) | C-14 | | 110 | 0.02 | 72 | 0.02 | 71 | 0.02 |
| 4-7 (Inv.) | (20) | | 115 | 0.02 | 80 | 0.02 | 87 | 0.02 |
| 4-8 (Comp.) | C-15 | | 121 | 0.02 | 73 | 0.03 | 75 | 0.02 |
| 4-9 (Inv.) | (25) | | 125 | 0.02 | 85 | 0.02 | 88 | 0.02 |
| 4-10 (Comp.) | C-11 | | 110 | 0.02 | 70 | 0.02 | 73 | 0.02 |
| 4-11 (Inv.) | (18) | | 120 | 0.02 | 80 | 0.02 | 81 | 0.02 |

*1stored at −30° C.
*2stored at 80% RH and 50° C.
*3stored at an oxygen partial pressure of 10 atm for 3 days.
*4unit: × $10^{-5}$ mole/mole of Ag.
*5Standard

C-13

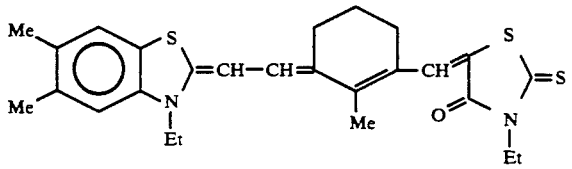

-continued

C-14

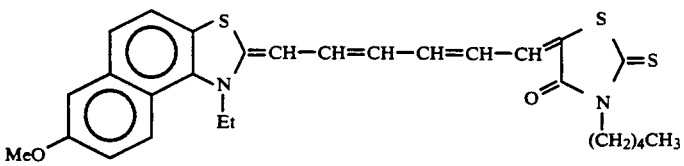

C-15

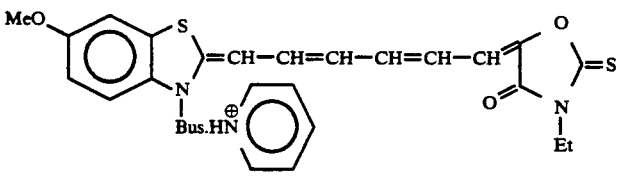

It can be determined from the results summarized in Table 4 that the sensitizing dyes of the present invention can provide a high sensitivity and a high storage stability.

EXAMPLE 6

Gelatin (80 g) was dissolved in water (1 liter), and further added thereto were a 5% aqueous solution (80 ml) of poly(diethylaminoethyl methacrylate), a 10% aqueous solution (30 ml) of saponin, a 2% aqueous solution (50 ml) of chrome alum, and a 2% aqueous solution (400 ml) of the methine compound (28) to prepare a dye gelatin solution.

The above dye gelatin solution was coated on a cellulose acetate photographic support to provide an antihalation layer. There were coated thereon (1) a silver bromochloride emulsion (a silver bromide content: about 17 mol %) which was subjected to a panchromatic spectral sensitization with the combined use of anhydro11-ethyl-3,3'-bis(sulfopropyl) naphtho[1,2-d]thiacarbocyanine hydroxide and 9-ethyl-3,3'-bis(sulfobutyl) selenacarbocyanine hydroxide, and (2) a protective gelatin layer, whereby a light-sensitive material for photomechanical process was prepared.

A contact screen (133 lines per inch) was tightly contacted to the light-sensitive material thus prepared and a wedge exposure was given. The light-sensitive material thus exposed was subjected to a development processing in a developing solution of the following composition at 20° C. for 3 minutes, followed by fixing, rinsing and drying according to the conventional methods.

| Composition of the developing solution | |
|---|---|
| Water | 500 ml |
| Sodium sulfite anhydrous | 30 g |
| Paraformaldehyde | 7.5 g |
| Sodium bisulfite | 2.2 g |
| Boric acid | 7.5 g |
| Hydroquinone | 22.5 g |
| Potassium bromide | 1.6 g |
| Water to make | 1 liter |

Stain was scarcely observed on an unexposed portion of the light-sensitive material thus processed. Further, a halftone image having an excellent edge gradient was obtained.

EFFECTS OF THE PRESENT INVENTION

It will be able to be understood from the results obtained in Examples 1, 2, 3, 4 and 5 that the silver halide emulsions using, as the sensitizing dyes, dyes of the present invention can provide a high sensitivity and are very stable even if they are stored under severe conditions. In particular, the sensitizing dyes for an infrared ray are extremely unstable, and the silver halide light-sensitive materials for an infrared ray commercially available in the market have had to be stored under a low temperature such as in a refrigerator. Accordingly, the improvement in the stability thereof has been required, and various attempts to improve the stability thereof have been made by combining various other compounds. It is very significant that stability has thus been improved with the sensitizing dyes themselves, as is the case in the present invention. Also, it can be found from the results in Example 6 that the compounds of the present invention can be used also as a dye for photography.

While the invention has been described in detail and with reference to specific embodiments thereof, it will be apparent to one skilled in the art that various changes and modifications can be made therein without departing from the spirit and scope thereof.

What is claimed is:

1. A silver halide emulsion containing at least one methine compound represented by Formula (I):

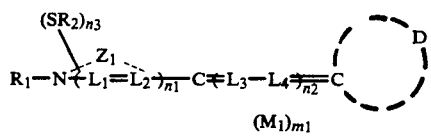

(I)

wherein $R_1$ represents an alkyl group; $R_2$ represents an unsubstituted ethyl or methyl group; $L_1$, $L_2$, $L_3$ and $L_4$ each represents a methine group; $Z_1$ represents a group of atoms necessary to form a benzothiazole, naphthothiazole, benzoxaxole, naphthoxaxole, benzimidazole, 2-quinoline, or 4-quinoline nucleus; $n_1$ represents 0 or 1; $n_2$ represents 0 or an integer of 1 to 4; $n_3$ represents an integer of 1 to 6; D represents a group of atoms necessary to form an acidic nucleus; $M_1$ represents a charge-neutralizing ion; and $m_1$ represents a number of 0 or more which is necessary to neutralize a charge contained in the compound.

2. The silver halide emulsion as claimed in claim 1, wherein $R_1$ represents an unsubstituted alkyl, carboxyalkyl, or sulfoalkyl group.

3. The silver halide emulsion as claimed in claim 1, wherein the acidic nucleus is a rhodanine, 2-thioxazolidine-2,4-dione, or a 2-thiohydantoin.

4. A silver halide photographic material, comprising a support having a silver halide emulsion containing a compound represented by Formula (I):

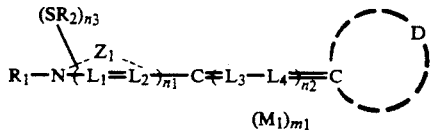

(I)

wherein $R_1$ represents an alkyl group; $R_2$ represents an unsubstituted ethyl or methyl group; $L_1$, $L_2$, $L_3$ and $L_4$ each represents a methine group; $Z_1$ represents a group of atoms necessary to form a benzothiazole, naphthothiazole, benzoxaxole, naphthoxaxole, benzimidazole, 2-quinoline, or 4-quinoline nucleus; $n_1$ represents 0 or 1; $n_2$ represents 0 or an integer of 1 to 4; $n_3$ represents an integer of 1 to 6; D represents a group of atoms necessary to form an acidic nucleus; $M_1$ represents a charge-neutralizing ion; and $m_1$ represents a number of 0 or more which is necessary to neutralize a charge contained in the compound.

5. The silver halide emulsion as claimed in claim 4, wherein $R_1$ represents an unsubstituted alkyl, carboxyalkyl, or sulfoalkyl group.

6. The silver halide emulsion as claimed in claim 4, wherein the acidic nucleus is a rhodanine, 2-thioxazolidine-2,4-dione, or a 2-thiohydantoin.

* * * * *